US006557846B2

(12) United States Patent
Martin et al.

(10) Patent No.: US 6,557,846 B2
(45) Date of Patent: May 6, 2003

(54) SAFETY LOCK FOR UPSTACKER

(75) Inventors: Merrill D. Martin, Oakland, CA (US); Daniel J. Talken, Lafayette, CA (US)

(73) Assignee: Martin Family Trust, Oakland, CA (US)

( * ) Notice: Subject to any disclaimer, the term of this patent is extended or adjusted under 35 U.S.C. 154(b) by 127 days.

(21) Appl. No.: 09/818,381

(22) Filed: Mar. 27, 2001

(65) Prior Publication Data

US 2002/0140152 A1 Oct. 3, 2002

(51) Int. Cl.[7] ..... B65H 29/50
(52) U.S. Cl. ..... 271/200; 271/201
(58) Field of Search ..... 271/200, 201, 271/207, 213

(56) References Cited

U.S. PATENT DOCUMENTS 2,660,432 A * 11/1953 Wilske et al.
2,901,250 A 8/1959 Martin
3,321,202 A 5/1967 Martin
3,419,266 A * 12/1968 Martin
3,549,144 A * 12/1970 Lucas
3,610,578 A * 10/1971 Lucas
6,019,367 A * 2/2000 Mandel et al. ..... 271/296
6,042,108 A 3/2000 Morgan et al.

OTHER PUBLICATIONS

Photo 1: Martin 2–C ZES.
Photo 2: Martin 2–C ZES.

* cited by examiner

*Primary Examiner*—David H. Bollinger
(74) *Attorney, Agent, or Firm*—James R. Cypher

(57) ABSTRACT

A safety lock for locking an upstacker conveyor in an elevated position by means of a safety lock having a retractable member which is inserted between elevating members and the frame of the upstacker. Specifically, the safety lock is inserted between elevating members such as link members which rotate with respect to the frame as the frame is lowered and form an ever decreasing angle with the frame as the frame is lowered. By inserting a retractable member so that the angle between the structural member and frame can no longer decrease, the upstacker is effectively prevented from lowering accidentally.

9 Claims, 6 Drawing Sheets

SAFETY LOCK FOR UPSTACKER

This invention relates to a safety lock for upstackers and in particular upstackers which are constructed with link members to raise and lower the discharge end of the stacker in a generally vertical plane.

BACKGROUND OF THE INVENTION

Examples of upstackers which operate in the manner described are disclosed in Martin U.S. Pat. No. 2,901,250 granted Aug. 25, 1959, Automatic Sheet Stacker Apparatus; Martin U.S. Pat. No. 3,321,202 granted May 3, 1965 Automatic Sheet Stackers; and Morgan U.S. Pat. No. 6,042,108 granted Mar. 28, 2000 Zero Feed Interrupt Sheet Stacker.

Upstackers of the type disclosed are designed with safety controls to prevent accidental lowering of the upstacker, but a satisfactory mechanical safety lock has not been provided. Various elongated props or poles similar to safety props found in auto shops for hydraulic automobile lifts have been attached to upstackers. Such props are cumbersome and expensive to build and install. Some props are not strong enough to withstand the tremendous hydraulic forces imposed by the operation of the machine.

SUMMARY OF THE INVENTION

The present invention provides a mechanical safety lock, which releasably engages and interlocks with the moving parts of the upstacker mechanism in such a way that the number of parts necessary to lock out the upstacker is minimized.

An object of the present invention is to provide a safety lock which is relatively simple to make, easy to install and works as an integral part of the mechanism.

A further object is to provide a safety lock which is very strong and reliable in attaining a lock-out of the upstacker mechanism.

Still another object is to provide a safety lock which is easily and unobtrusively carried as a part of the machine when it is in the inoperative mode.

A still further object is to provide a safety lock which is easily and quickly engaged by the operator.

A further object is to provide a safety lock which signals the operator and others when it is in the lock-out mode.

Still another object is to provide a procedure which is safe and reliable for removing the safety lock from the lock-out mode.

BRIEF DESCRIPTION OF THE INVENTION

Figure 1:
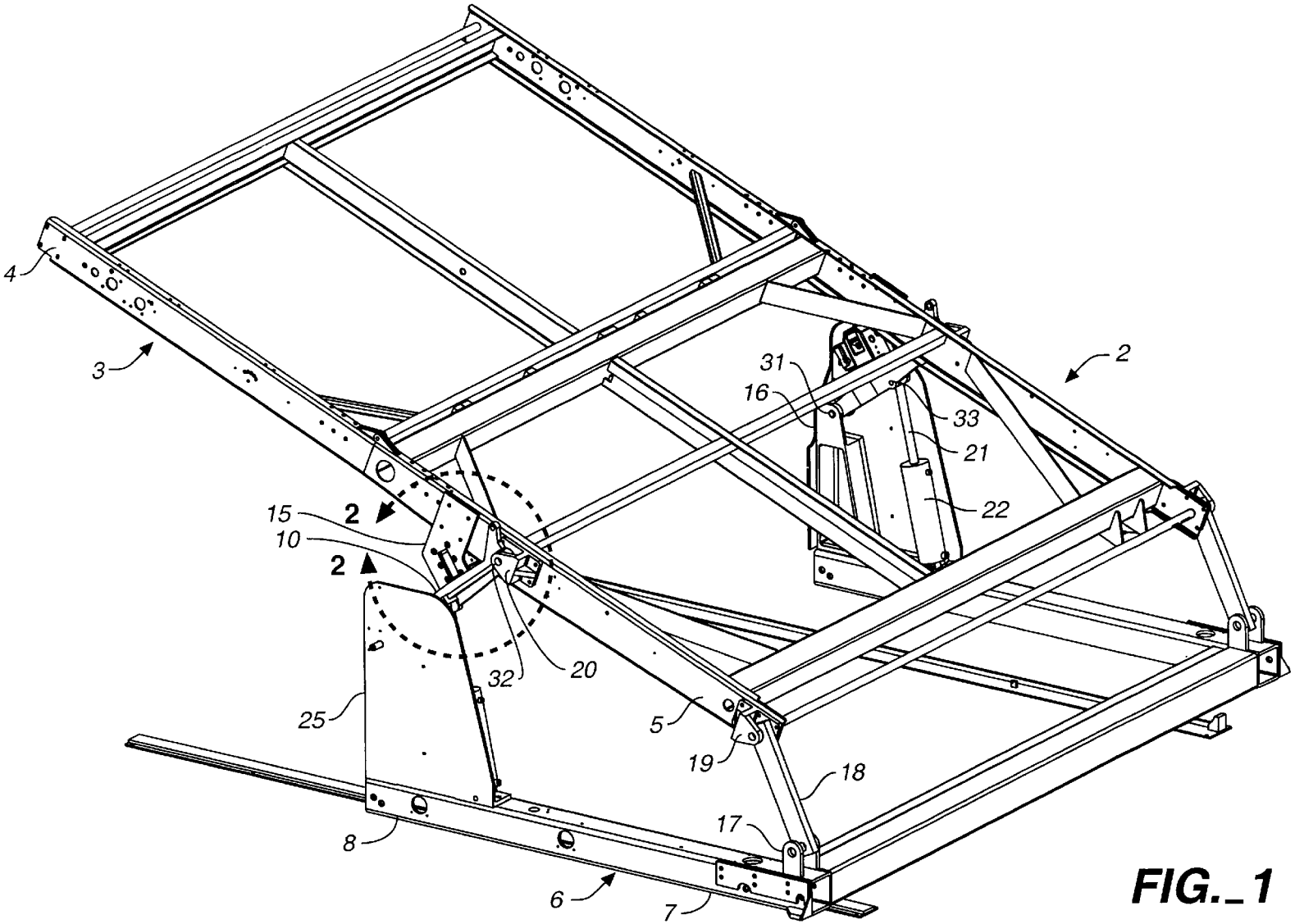
FIG. 1 is perspective view of the elevating and lowering mechanism of a 4 link upstacker. All of the conveyor mechanism supported by the frame of the upstacker has been removed so that the operation of the present invention in relation to the elevating and lowering mechanism may be more easily understood. The details of construction and movement and purpose of an upstacker may be clearly seen in the patents referenced above and are herein incorporated by reference.

Referring to the drawings, and in particular to FIG. 1, the present invention is a safety lock 1 for an upstacker 2 which includes: a frame 3 having a downstream end 4 and an upstream end 5, a base 6 having an upstream end 7 and a downstream end 8, and elevating means connecting the base 6 to the frame 3 for elevating the frame 3 above the base 6.

Figure 2:
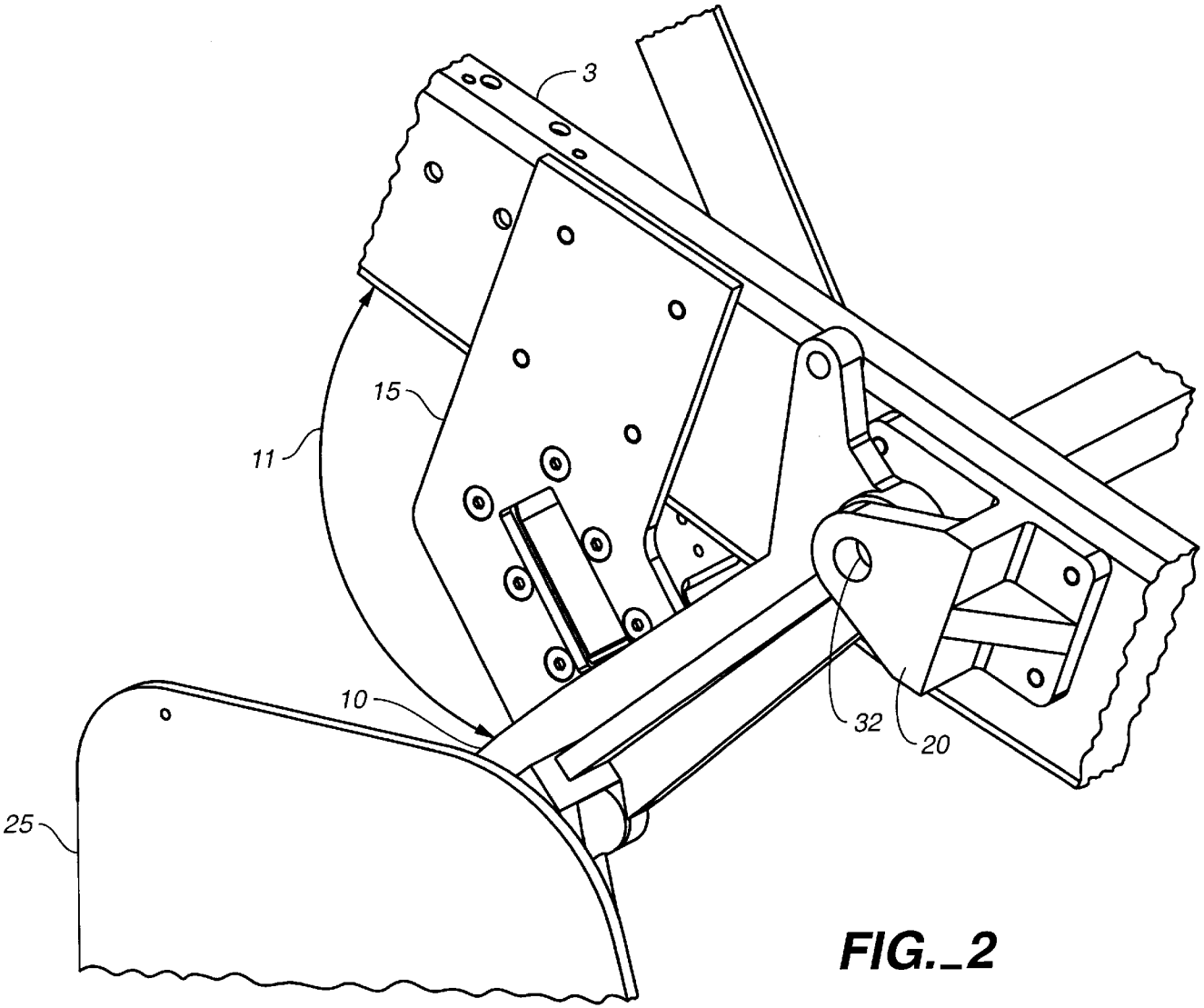
FIG. 2 is an enlarged perspective view of a portion of the invention and the upstacker taken in the vicinity of the circled area indicated by the numbers 2—2 illustrated in FIG. 1.
Figure 3:
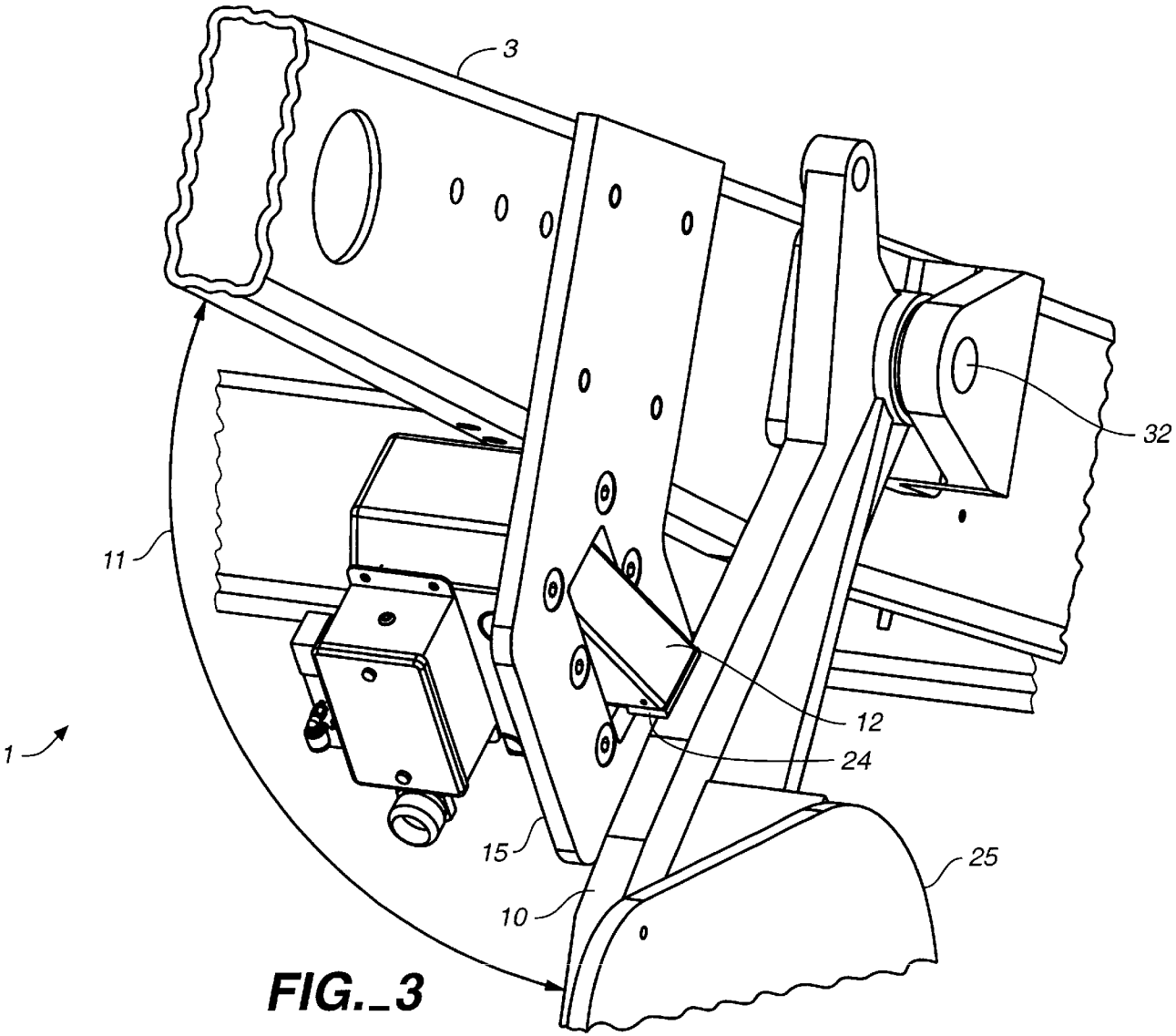
FIG. 3 is an enlarged perspective view of generally the same portion of the device illustrated in FIG. 2 with additional parts of the safety lock of the present invention installed on the upstacker mechanism. The view of FIG. 2 has been rotated about a vertical axis in a clock wise direction about 90°.
Figure 4B:
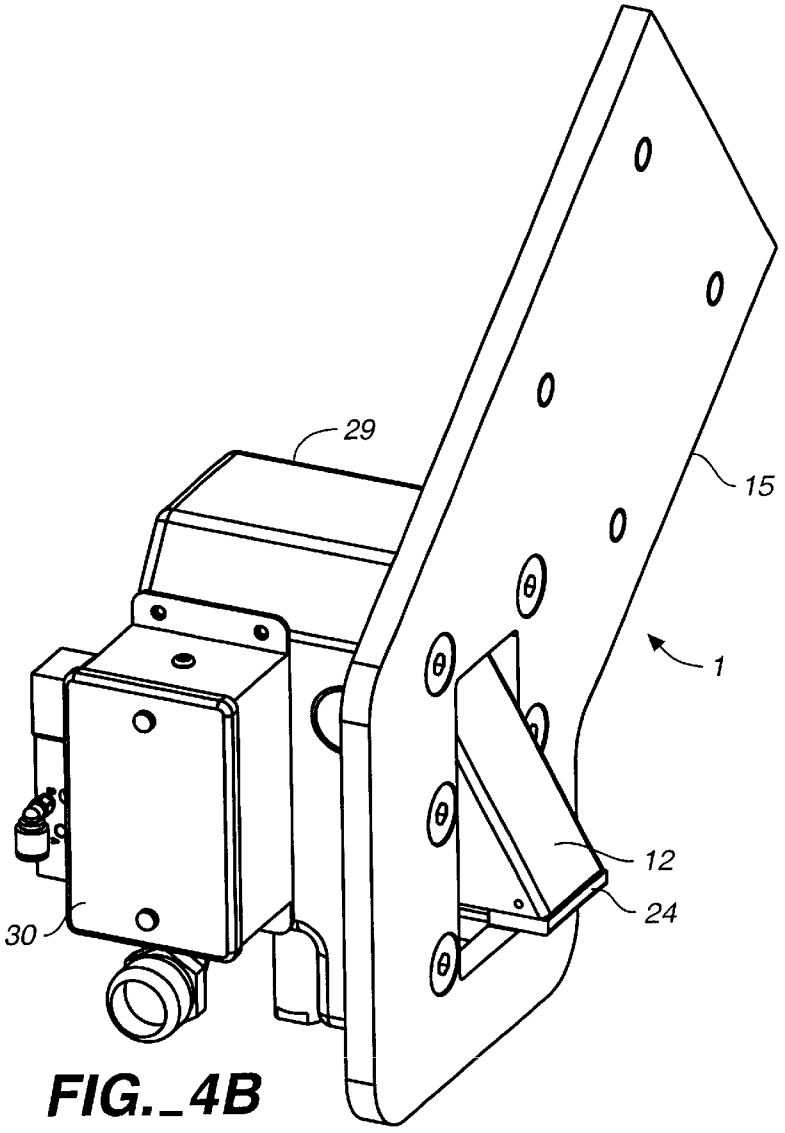
FIG. 4B is another view of the safety lock illustrated in FIG. 4A with the safety lock in the lock-out mode.
Figure 4A:
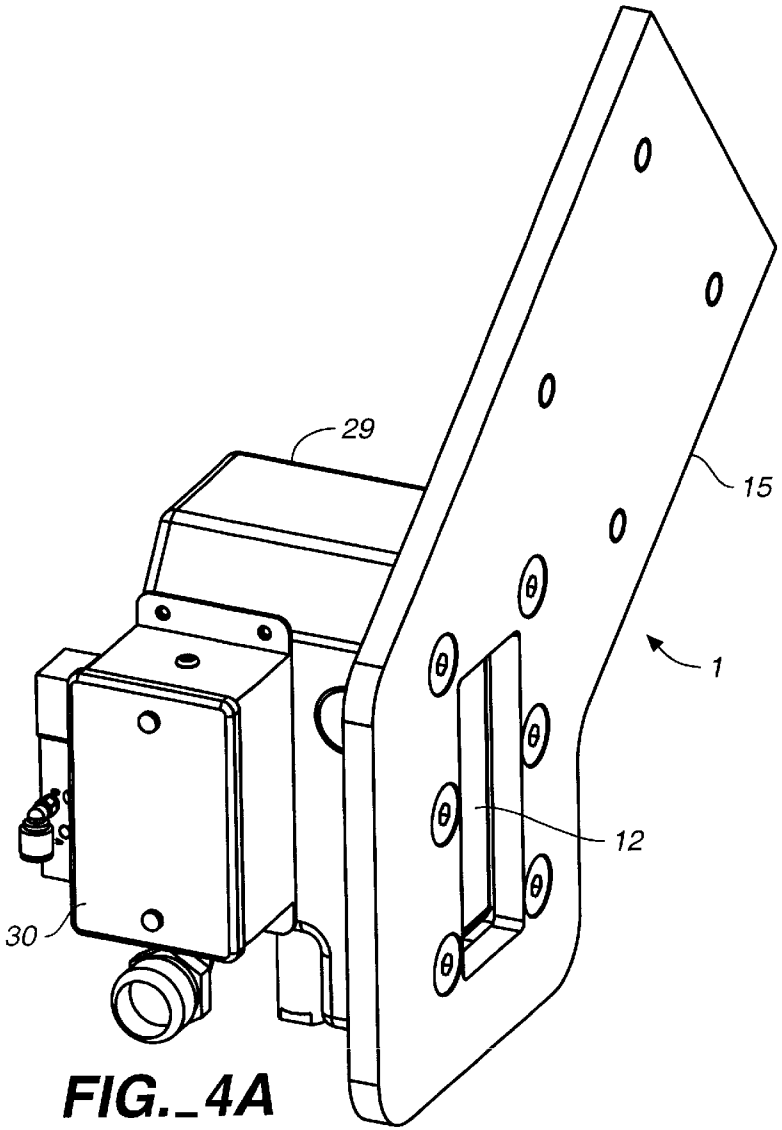
FIG. 4A is a further enlarged perspective view of the safety lock of the present invention illustrated in FIGS. 2 and 3 but removed from the upstacker structure. The safety lock is shown in the non-activated mode.
Figure 5B:
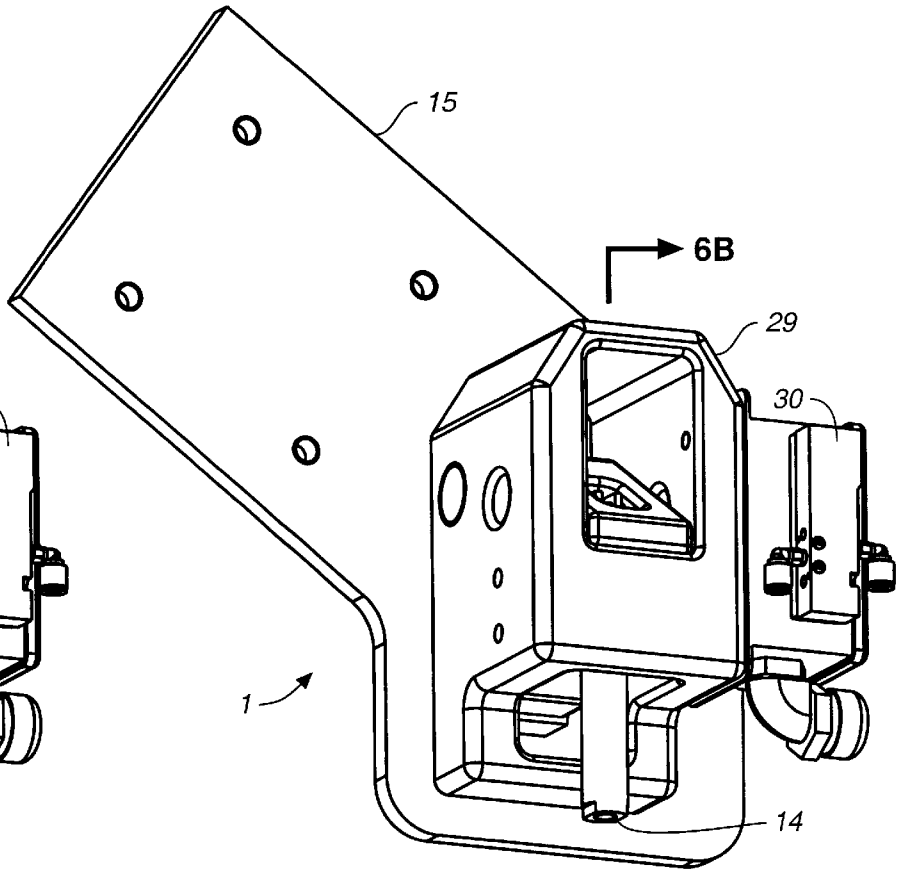
FIG. 5B is another view of the safety lock illustrated in FIG. 5A. The safety lock is in the lock-out mode illustrated in FIG. 4B.
Figure 5A:
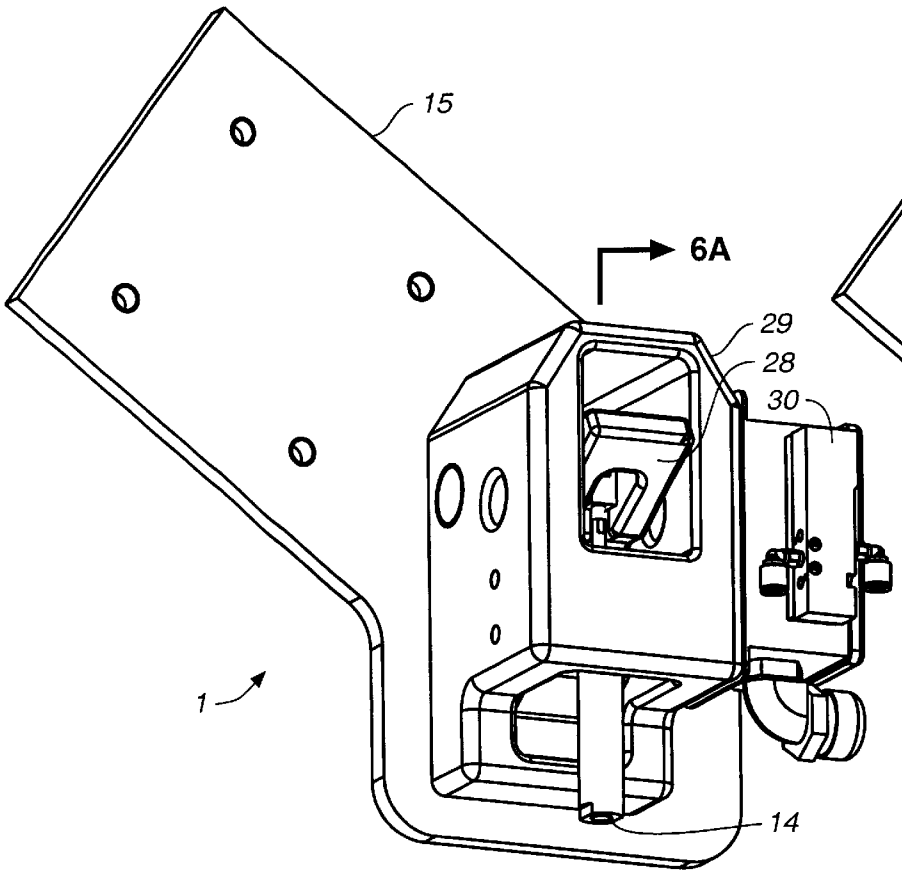
FIG. 5A is another view of the safety lock illustrated in FIG. 5A rotated about a generally vertical axis about 180°. The safety lock is in the non-activated mode illustrated in FIG. 4A.
Figure 6B:
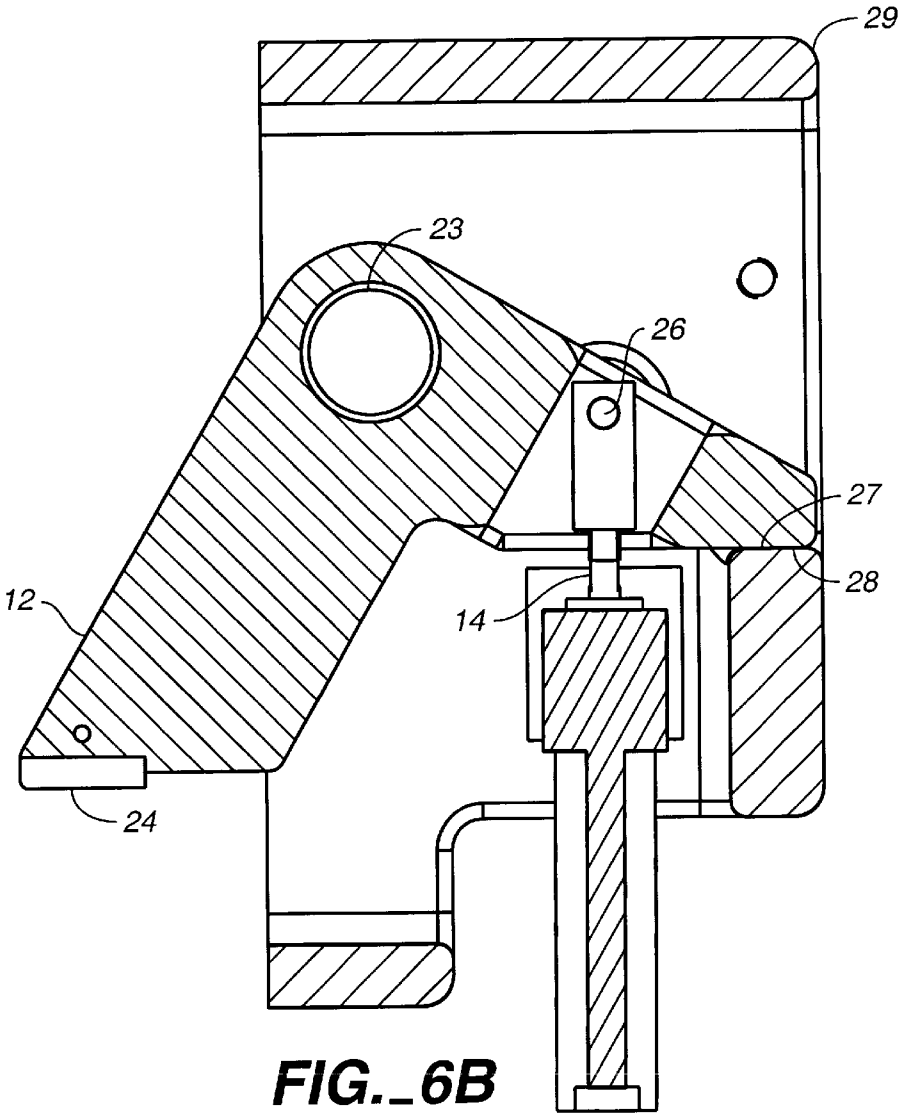
FIG. 6B is side, further enlarged, cross sectional view of the safety lock taken along the plane of line 6B—6B shown in FIG. 5B. The safety lock is in the lock-out position.
Figure 6A:
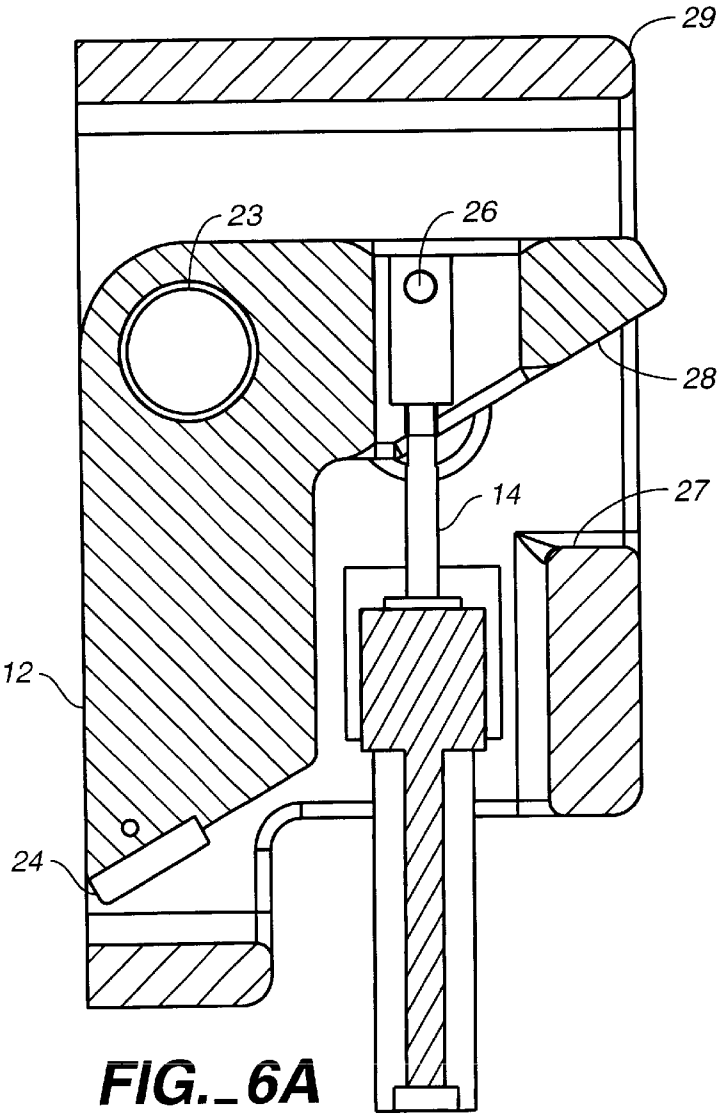
FIG. 6A is a side, further enlarged, cross sectional view of the safety lock taken along the plane of line 6A—6A shown in FIG. 5A. The safety lock is in the non-activated mode.

The elevating means includes: a first link member 10 which changes its angular relationship to the frame 3 (see angle 11 in FIGS. 2, and 3) with a decrease in elevation of the frame 3. The safety lock 1 further includes a retractable member 12 having a first or rest position operably out of contact with the frame 3 and the first link member 10 and a second lock-out position operably engaging the frame 3 and the first link member 10 preventing angular change between the frame 3 and the first link member 10.

The structural key to the safety lock 1 is the fact that the safety lock 1 is deployed between the frame 3 and one of the elevating link members. In the preferred form of the invention the safety lock 1 is preferably deployed between the frame 3 and first link member 10 which is an elevating link member. Operation of the invention may be understood as follows. When first link member 10 is elevating frame 3, the angle 11 between first link member 10 and frame member 3 is increasing. When first link member 10 is lowering frame 3, angle 11 is decreasing. Thus by operatively inserting safety lock 1 between frame 3 and first link member 10, angle 11 cannot decrease, thus preventing frame 3 from accidentally lowering when safety lock 1 is in the lock-out position.

In the preferred form of the invention, the safety lock 1 is used when the upstacker is being serviced or when material accidentally falls beneath the stacker and needs to be retrieved. In both instances, the upstacker must be temporarily taken out of service and the safety lock activated. In this instance, the safety lock is preferably includes a retractable member 12 which is moved to the lock-out position preferably when the frame 3 is at or near its highest elevation position to provide maximum headroom for workers to move beneath the upstacker.

Where other considerations take precedence, the safety lock could be programed to provide lock-out at another preselected elevation of the frame 3.

As shown in FIGS. 4A–6B, the safety lock 1 of the present invention preferably includes a retractable member 12 which is a pivotally mounted member movable to lock-out and retracted positions. Specifically, retractable member 12 reciprocally rotates about pivot pin 23. Retractable member 12 may have a striker plate 24 for engagement with the link 10. Retractable member 12 may be reciprocated by rod 14 pivoted to pivot pin 26. End 28 of retractable member 12 is constructed to engage stop member 27 attached to frame 29 of the safety lock 1. A pneumatic or electromechanical power source 30 moves rod 14 from a retracted position to a lock-out position. Frame 29 is connected to mounting member 15 which is connected to frame 3 of upstacker 2.

Upstacker 2 of the present invention could be raised so that frame 3 remains in a horizontal plane, but preferably, an elevating means including a plurality of links for elevating the downstream end 4 of the frame 3 above the upstream end 5; and the elevating means is preferably arranged to elevate the downstream end of the frame in a generally vertical plane.

Upstacker 2 preferably includes elevating means which includes a first pivot bracket 16 connected to the downstream end 8 of the base 6, a second pivot bracket 17 connected to the upstream end 7 of the base 6, a second link 18 pivotally connected to the second pivot bracket 17, a third pivot bracket 19 connected to the upstream end 5 of the frame 3, and a fourth pivot bracket 20 connected to a down stream portion of the frame 3. First link member 10 is pivotally connected to the first bracket 16 at pivot point 31 and is pivotally connected to a fourth pivot bracket 20 at pivot point connected to the frame 3.

A piston rod 21 pivotally connected at pivot point 33 to the first link member 10 and reciprocally connected to a piston in a hydraulic cylinder 22 connected to the base 6 raises and lowers the frame 3.

Mounting member 15 is preferably connected to the frame 3, downstream of the fourth pivot bracket 20 which carries the safety lock 1.

The present invention sets forth a method for locking an upstacker 2 in an elevated position and includes the steps of moving an upstacker frame 3 to a point at or near its highest elevation; moving the retractable member 12 of the safety lock 1 to a lock-out position for close or registering engagement with a link member such as first link member 10 of the elevating means preventing angular change between the link member and the frame; moving the frame 3 to an elevated position above the elevation of the frame 3 in the lock-out position; and resuming normal operation of the upstacker 2.

The upstacker 2 is symmetrically formed and the elevating link mechanism is duplicated on both sides of the frame 3. Numbers are not assigned to this duplicate system. In like manner two pneumatic cylinders raise the frame and two safety lock's are provided to lock out the system.

We claim:

1. A safety lock for an upstacker including a frame having a downstream end and an upstream end, a base having an upstream end and a downstream end, and elevating means connecting said base to said frame for elevating said frame above said base comprising:

a. said elevating means including a first link member which changes its angular relationship to said frame with a decrease in elevation of said frame; and b. said safety lock including a retractable member having a first or rest position operably out of contact with said frame and said first link member and a second lock-out position operably engaging said frame and said first link member preventing angular change between said frame and said first link member.

2. A safety lock for an upstacker as described in claim 1 comprising:

a. said safety lock is deployed between said frame and said first link member which is an elevating link member.

3. A safety lock for an upstacker as described in claim 1 comprising:

a. said safety lock is deployed between said frame and said first link member preventing said angular change from decreasing.

4. A safety lock for an upstacker as described in claim 1 comprising:

a. said safety lock retractable member is moved to said lock-out position when said frame is at or near its highest elevation position.

5. A safety lock for an upstacker as described in claim 1 comprising:

a. said retractable member is a pivotally mounted member movable to lock-out and retracted positions.

6. A safety lock for an upstacker as described in claim 5 comprising:

a. a remotely activated rod member connected to said pivotally mounted retractable member.

7. A safety lock for an upstacker as described in claim 1 comprising:

a. said safety lock is connected to a mounting member attached to said upstacker frame.

8. A safety lock for an upstacker as described in claim 1 comprising:

a. said elevating means includes a plurality of links for elevating the downstream end of said frame above said upstream end; and b. said elevating means being arranged to elevate said downstream end of said frame in a generally vertical plane.

9. A safety lock for an upstacker as described in claim 1 comprising:

a. said elevating means includes a first pivot bracket connected to said downstream end of said base, a second pivot bracket connected to said upstream end of said base, a second link pivotally connected to said second pivot bracket, a third pivot bracket connected to said upstream end of said frame, and a fourth pivot bracket connected to a down stream portion of said frame;

b. said first link member is pivotally connected to said first bracket and is pivotally connected to a fourth pivot bracket connected to said frame;

c. a piston rod pivotally connected to said first link member and reciprocally connected to a piston in a hydraulic cylinder connected to said base raises and lowers said frame;

d. a mounting member connected to said frame, downstream of said fourth pivot bracket; and e. said safety lock is connected to said mounting member.

* * * * *